US005924466A

United States Patent [19]

Kröner et al.

[11] Patent Number: 5,924,466

[45] Date of Patent: Jul. 20, 1999

[54] JOINT-ARM AWNING

[75] Inventors: Sven Kröner, Mettingen; Bernhard Wessels, Rheine; Justus Schmitz, Emsdetten, all of Germany

[73] Assignee: Schmitz-Werke GmbH & Co., Emsdetten, Germany

[21] Appl. No.: 08/893,616

[22] Filed: Jul. 11, 1997

[30] Foreign Application Priority Data

Jul. 25, 1996 [DE] Germany ..... 296 12 904 U

[51] Int. Cl.[6] ..... E04F 10/00

[52] U.S. Cl. ..... 160/78; 160/22; 160/67; 160/70; 160/79; 403/84; 403/97; 248/273

[58] Field of Search ..... 160/22, 66, 67, 160/70, 78, 79; 403/48, 84, 97, 323, 322.3, 322.1; 248/273, 292.12

[56] References Cited

U.S. PATENT DOCUMENTS

| | | | |
|---|---|---|---|
| 2,144,827 | 1/1939 | Anton | 248/273 X |
| 2,880,956 | 4/1959 | Beckstett | 248/273 |
| 2,890,853 | 6/1959 | D'azzo | 248/273 |
| 4,590,642 | 5/1986 | Hesener | 160/22 X |
| 4,599,998 | 7/1986 | Castillo | 403/84 X |
| 5,039,247 | 8/1991 | Young et al. | 403/84 X |
| 5,119,867 | 6/1992 | Lukos | 160/79 X |
| 5,121,782 | 6/1992 | Renkhoff et al. | 160/22 |
| 5,381,814 | 1/1995 | Brandon | 160/22 X |
| 5,427,168 | 6/1995 | Lofhausen | 160/22 X |
| 5,492,162 | 2/1996 | Lofhausen | 160/22 |

FOREIGN PATENT DOCUMENTS

| | | | |
|---|---|---|---|
| 0000915 | 3/1979 | European Pat. Off. | 160/22 |
| 7232630 | 9/1972 | Germany . | |
| 2408060 | 2/1974 | Germany . | |
| 2753955 | 6/1979 | Germany | 160/22 |
| 2753959 | 6/1979 | Germany | 160/22 |
| 2834486 | 2/1980 | Germany | 160/22 |
| 517230 | 12/1971 | Switzerland . | |
| 91/17329 | 11/1991 | WIPO | 160/22 |

*Primary Examiner*—Daniel P. Stodola
*Assistant Examiner*—Bruce A. Lev
*Attorney, Agent, or Firm*—Browdy and Neimark

[57] ABSTRACT

In a joint-arm awning comprising two joint arms disposed on a support pipe, it being possible by fastening brackets to join the support pipe to the wall of a housing, and devices being provided for adjustment of the angle of inclination of the awning in order to constructionally simplify the adjustment of the angle of inclination and obtain defined retraction conditions regardless of the adjusted angle of inclination, that the support pipe is substantially round, having a longitudinal groove, with which engages a locking element for adjustment of the angle of inclination.

4 Claims, 4 Drawing Sheets

JOINT-ARM AWNING

BACKGROUND OF THE INVENTION

1. Field of the Invention

The invention relates to a joint-arm awning comprising two joint arms disposed on a support pipe, it being possible by means of fastening brackets to join the support pipe to a wall of a housing, and devices being provided for the adjustment of the angle of inclination of the awning arms.

2. Background Art

Joint-arm awnings of the generic type are known as box-type awnings or open awnings. Conventionally, in particular with open awnings, adjustment of the angle of inclination of the joint arms relative to the wall or the ground is effected by each joint arm being provided with an arrangement for the adjustment of the angle of inclination. Correspondingly, conventional constructions are comparatively complicated and expensive.

SUMMARY OF THE INVENTION

Proceeding from this, it is the object of the invention to embody a joint-arm awning of the type mentioned at the outset in such a way that adjusting the angle of inclination is simplified constructionally and that defined retraction conditions are given, which are constant regardless of the adjusted angle of inclination.

According to the invention, this object is attained in that the support pipe is substantially round, having a longitudinal groove, in that each fastening bracket has a bearing section on which to place the support pipe by partially positive engagement with the bearing section, in that a securing section of the fastening bracket partially positively and detachably fits over the upper side of the support pipe placed on, and in at least the vicinity of the fastening brackets, the support pipe has a recess with which an actuating and arresting cam adjustable in height relative to the bearing section engages in such a way that the support pipe are pivotable and the angle of inclination of the joint arms is adjustable by height adjustment of the cam.

As a result of this arrangement, it is easily possible to pivot the support pipe and thus the engaged joint arms as well as the entire awning and to adjust a desired angle of inclination.

Favorably, it is provided that the cam has a section of parallel motion which is guided parallel in the bearing section of the fastening bracket and which is provided with a threaded hole with which engages a setscrew supporting itself by its head on the bearing section. From below the setscrew can be inserted approximately parallel to the surface of wall, on which the fastening bracket rests so that easy actuation of the cam from below is ensured.

Favorably, the recess of the support pipe can be a groove-type, in particular semi-circular impression, the outer end of the cam, which is of corresponding shape, being able to engage positively with this groove.

Finally, it is advantageously provided that by means of a projection, one end of the securing section positively engages with a corresponding recess of the fastening bracket and that at its other end, the securing section has a threaded hole for a locking screw to engage which passes through a flush threaded hole on the outside of the bearing section. In this way, it is easily possible to fix an adjusted angle of inclination.

In keeping with another variant, it is provided that a bearing section of the fastening brackets or of support pipe holders substantially fits around the support pipe and has threaded holes offset by an angle into which to screw a locking screw depending on the desired angular adjustment, the locking screw engaging with at least one longitudinal groove of the support pipe. In other words, depending on the desired angular adjustment, one of the available threaded holes is chosen for the locking screw to be screwed in.

Provision can also be made for the support pipe to have a plurality of longitudinal grooves or longitudinal bulgings offset by an angle along its circumference. Accordingly, only a single threaded hole can then be provided and the support pipe is pivoted correspondingly.

In keeping with another embodiment it is provided that arm brackets are provided, positively fitting around the support pipe at least in sections and having threaded holes offset by an angle for a locking screw to be inserted, which engages with the at least one longitudinal groove of the support pipe for adjustment of the angle of inclination of the joint arms. In this embodiment, it is not the support pipe as such that is pivoted, but the joint arms relative to the support pipe.

In this variant, too, it is possible, instead of or additionally to a plurality of threaded holes, to provide a plurality of longitudinal grooves which are disposed on the circumference of the support pipe, offset by an angle.

In the foregoing, embodiments are dealt with, in which longitudinal recesses are provided on the support pipe. By kinematic reversal, it can of course also be provided that the support pipe has longitudinal bulgings and that corresponding recesses therefor are disposed in the holder or in cams that act on the support pipe.

In another embodiment, a joint-aRm bracket also fits around the support pipe in the way of a U-shaped bow, a cam nose which engages with the groove of the support pipe, being displaceable by means of a setscrew, which engages with the thread of a set-cam, adjustment of the angle of inclination thus being feasible.

Details of the invention will become apparent from the ensuing description of a preferred embodiment, taken in conjunction with the drawing.

DESCRIPTION OF THE PREFERRED EMBODIMENT

Figure 3:
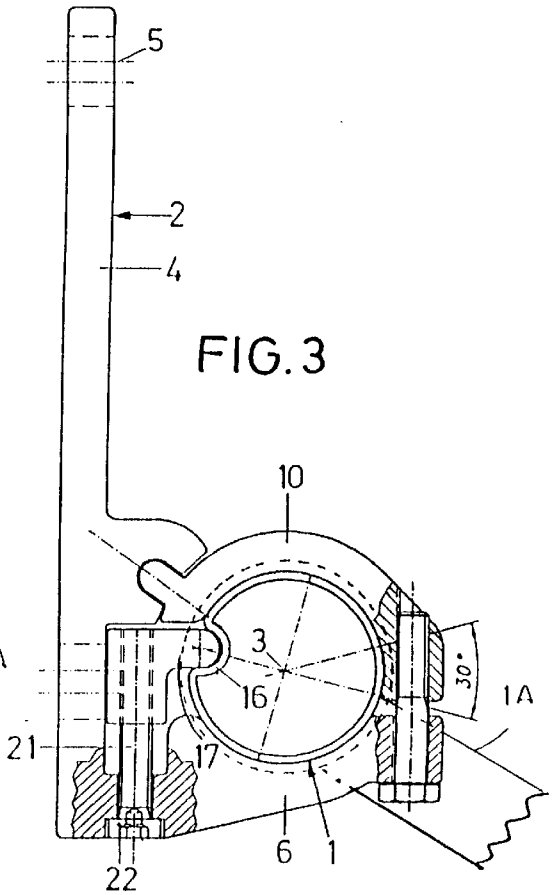
FIGS. 1 to 3 are lateral views (partially cut) of the support-pipe bearing portion with various adjusted angles of inclination in a first embodiment.

The drawing illustrates a support pipe 1 which can be mounted on the wall by means of two fastening brackets 2. Joint arms 1*a* are fixed to the support pipe 1. Further, a cloth shaft comprising a bearing arrangement (not shown) is mounted on the support pipe 1, from which the awning cloth—to the front edge of which a drop-out section is fixed—is unwound when the joint arms are extended by the joint arms acting pivotally on the outer sides of the drop-out section. Since the joint arms 1A are non-rotatably joined to the support pipe 1, pivoting of the support pipe 1 about its longitudinal axis 3 corresponds to a change of the angle of inclination of the joint arms 1A. The mounting and the possibility of pivoting of the support pipe 1 is described in detail in the following:

The fastening bracket 2 comprises a plate-type section 4 to be fixed to a wall and having drilled holes 5 for fastening screws. A bearing section 6 extends outward from the lower end of the wall section 4 and is provided, on its outside, with a threaded hole 7 for a holding screw 8. Between the wall section 4 and the hole 7, the bearing section 6 is provided with a recess 9 in the shape of a segment of a circle, the radius of which corresponds to the radius of the support pipe 1. During the mounting job, the support pipe 1 can be placed on this bearing section 6. A securing section 10 of the fastening bracket 2 has a projection 11 which engages positively with a corresponding recess 12 on a support 13 of the wall section 4. The securing section 10 also has a recess 14, which, in cross-section, exhibits the shape of a segment of a circle and a radius corresponding to that of the support pipe 1 and which can positively fit from above over the support pipe 1. At the outer end of the securing section 10, provision is made for a threaded hole 15 which is in alignment with the threaded hole 7 of the bearing section 6 so that a holding screw 8 can be screwed in from below, which braces the securing section 10 and the bearing section 6, thus arresting the support pipe 1.

The support pipe has a lateral recess 16 in the form of a groove which, in cross-section, has the shape of a segment of a circle and with which engages a cam 17 of corresponding shape; a section of parallel motion 18 adjoins the cam 17, the section 18 being approximately perpendicular to the longitudinal extension of the cam and being guided in a corresponding section of parallel motion 19 of the wall section 4 parallel to the surface 20, resting on the wall, of the fastening bracket 2. The section of parallel motion 18, which is connected with the cam 17, comprises a threaded hole, with which a setscrew 21 engages, the head 22 of which supports itself on the bottom 23 of a blind hole and which is screwed from below into the wall section 4.

Figure 2:
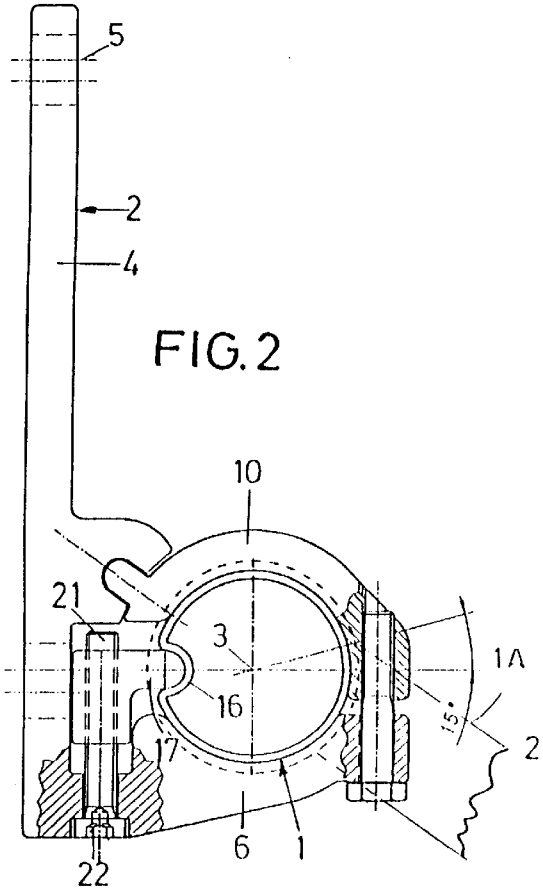
Figure 1:
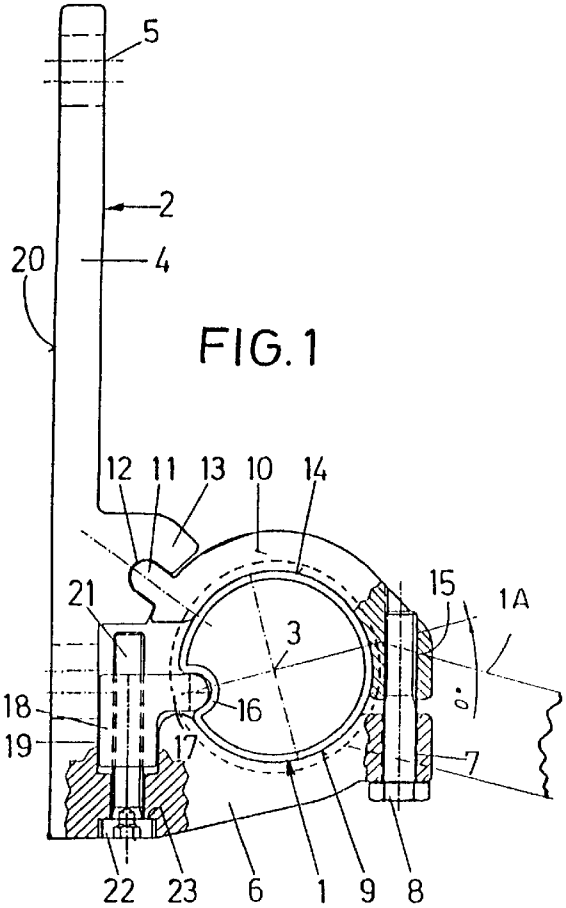

A comparison of FIGS. 1 to 3 shows that the cam 17 is adjustable in height by means of the setscrew 21. By the cam 17 engaging with the groove-type recess 16, the support pipe 1 is pivoted, starting from the position seen in FIG. 1, clockwise to the right by 15° into the position seen in FIG. 2 and by 30° into the position seen in FIG. 3.

Consequently, simple and highly accurate adjustment of the angle of inclination is possible, the position of the substantial parts of the awning relative to each other remaining unchanged so that the function and retraction behavior of the awning are totally independent of the chosen adjustment of the angle of inclination.

Figure 5:
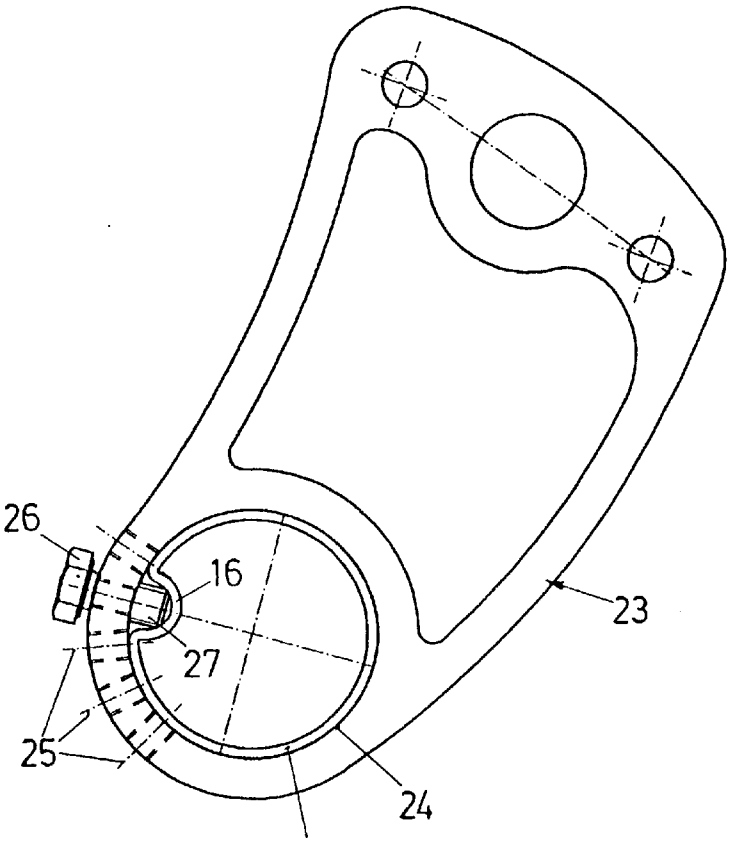
FIGS. 4 and 5 are diagrammatic views of a second embodiment.
Figure 4:
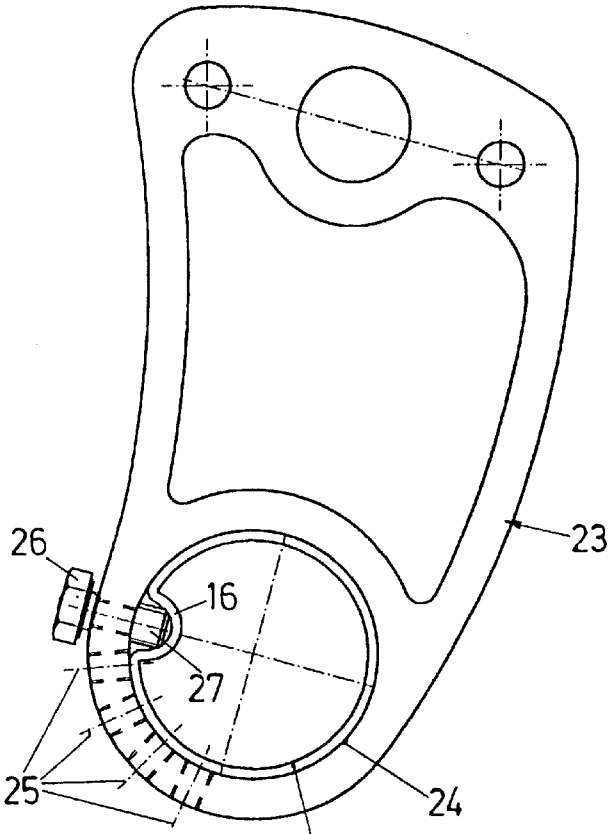

In the embodiment seen in FIGS. 4 and 5, support pipe holders 23 are provided, having a circular recess 24 for the accommodation of the support pipe 1. Threaded holes 25 are disposed around the recess 24, offset by an angle, it being possible to screw a locking screw 26 into the holes 25, the inner end 27 of which engages with a groove 16 of the support pipe 1.

A comparison of FIGS. 4 and 5 shows that angular adjustment is possible by a certain threaded hole 25 being chosen into which the locking screw 26 is screwed.

Figure 7:
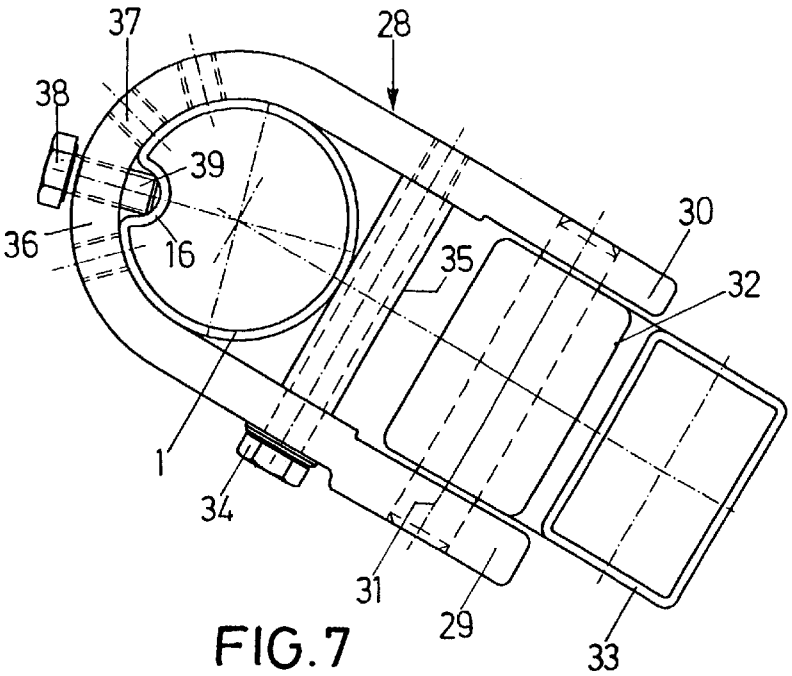
FIGS. 6 and 7 illustrate a third embodiment, in which the joint arms are pivoted relative to the support pipe.
Figure 6:
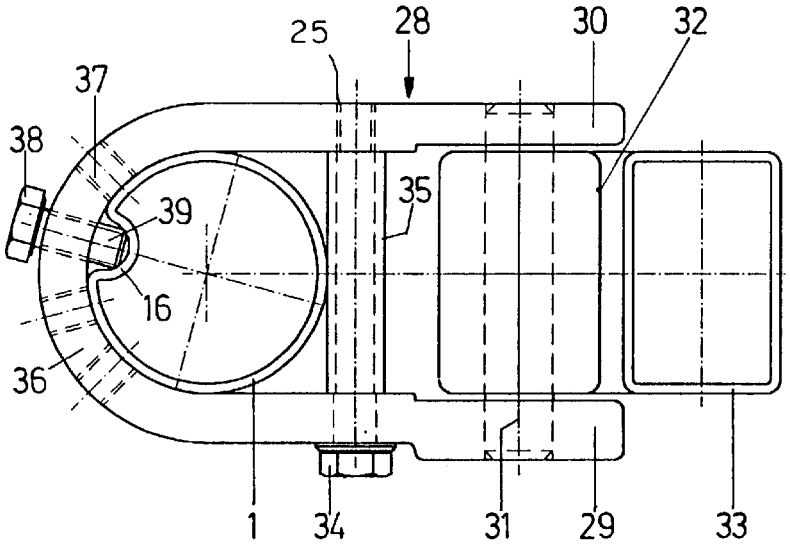

In the embodiment seen in FIGS. 6 and 7, the support pipe itself is not mounted pivotally.

Two arm brackets 28 are disposed on the support pipe 1, which are in the form of a U-shaped bow and fit positively around the support pipe by an angle of 180°. An inner joint-arm section 32 lodges in the two legs of the U 29, 30 pivotally about a pivot axis 31, the inner joint-arm section 32 being pivotally connected with an outer joint-arm section 33. Starting from the leg of the U 29, a screw 34 engages with a threaded hole 25 on the opposite leg of the U 30 and a spacing sleeve 35 is provided between the two legs of the U 29, 30.

The section 36 of the U-shaped bow 28 which positively fits around the support pipe 1 is provided with several threaded holes 37, which are offset by an angle and into which a locking screw 38 can be inserted, the inner end 39 of which engages with the groove 16 of the support pipe 1. The comparison of FIGS. 6 and 7 shows that angular adjustment can be effected, depending on the selection of one of the threaded holes 37.

The drawing does not show a variant in which bulgings are provided on the support pipe instead of one or several longitudinal recesses, the bulgings positively engaging with corresponding recesses on the side of the holder.

Figure 8:
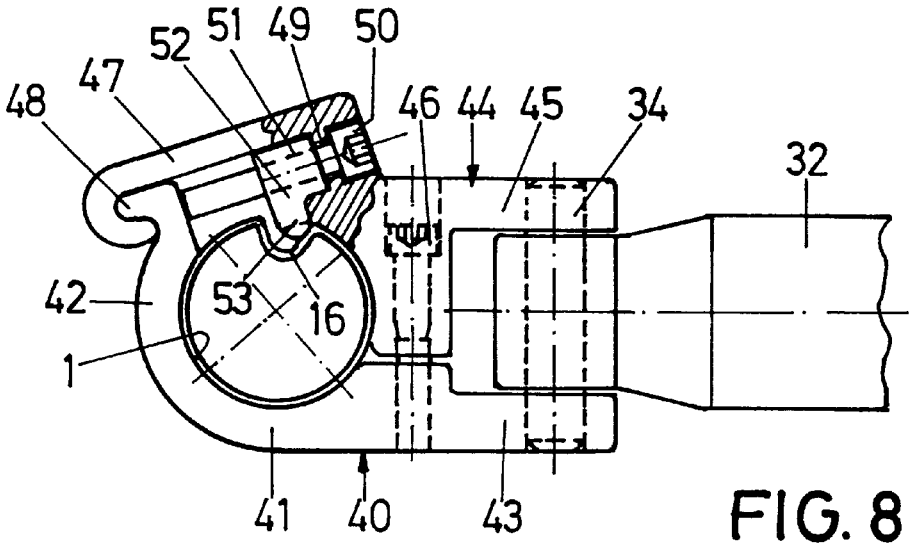
FIGS. 8 and 9 illustrate various adjusted angles of inclination in another embodiment.
Figure 9:
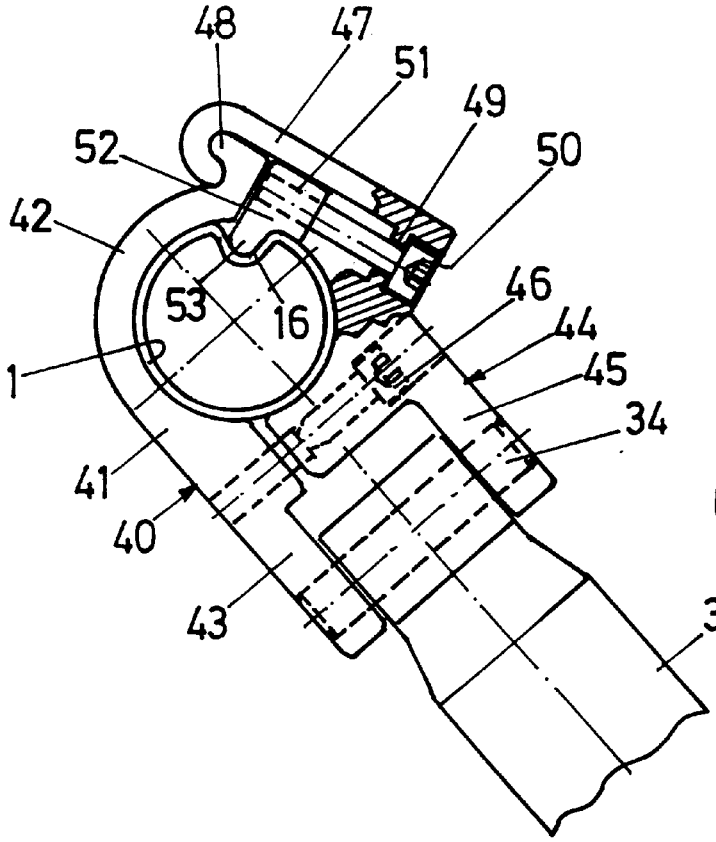

The embodiment seen in FIGS. 8 and 9 either provides for angular adjustment of the joint arms relative to the support pipe when the support pipe is stationary or for superimposed angular adjustment of the support pipe in the way described above and additional angular adjustment of the joint arms so that on the whole very wide ranges of adjustment or very fine graduations can be accomplished.

By analogy to the embodiment according to FIGS. 6 and 7, arm brackets 40 are provided, on which the inner joint-arm section 32 is mounted pivotally about a pivot bearing pin in the form of a screw 34. The arm brackets 40 are of the type of a U-shaped bow, consisting of two parts, a part 41 positively fitting around the support pipe by a curved section 42 and comprising a leg of the U 43 and the other part 44 comprising the second leg of the U 45, it being possible to connect both legs of the U 43, 45 by means of a screw 46.

The part 45 is provided with a hooked appendix 47, which fits positively over a corresponding projection 48 of the other part 43.

A setscrew 50 engages with a drilled hole 49 of the second part 45, by means of an internal thread 51 displacing a set-cam 52 in the axial direction, a cam nose 53 of which engages with the groove 16 of the support pipe 1 so that the cam nose 53 is adjustable by means of the setscrew 50, as a result of which the angle of inclination of the joint-arm section 32 and of the entire corresponding joint arm, respectively, is adjustable as seen in the comparison of FIGS. 8 and 9.

What is claimed is:

1. A joint-arm awning comprising joint-arms (1A) fixed on a support pipe (1), said support pipe (1) engaged to fastening brackets (2) fixable to a wall, adjustment means engaged on each of said fastening brackets for rotatably adjusting the support pipe (1) relative to the fastening brackets (2) so as to adjust the angle of inclination of the awning arms (1A), wherein the support pipe (1) is substantially round and has a lateral recess (16) extending to an inside of said support pipe (1) in a radial direction from a periphery of said support pipe (1), said adjustment means having a cam (17) engageable in said lateral recess (16) and wherein a cross-section of the cam (17) corresponds to a cross-section of said lateral recess (16) so that the cam fits into said lateral recess (16) and prevents any relative movement in a tangential direction of the support pipe (1) except when said adjustment means is rotatably adjusting the support pipe (1)

wherein each fastening bracket (2) comprises a bearing section (6), on which the support pipe (1) is placed, partially positively engaging with the bearing section (6), wherein a securing section (10) of the fastening bracket (2) partially positively and detachably fits over the upper side of the support pipe (1) placed thereon, and the support pipe (1) lateral recess (16), with which cam (17) is adjustable in height relative to the bearing section (6), engages in such a way that the support pipe (1) is pivotable and thus the angle of inclination of the joint arms is adjustable by height adjustment of the cam (17).

2. A joint-arm awning according to claim 1, wherein the cam (17) has a section (18), which is guided parallel to a surface (20) in the bearing section (6) on the fastening brackets (2), and which is provided with a threaded hole, in which is engaged a setscrew (21) having a head (22) engaged on the bearing section (6).

3. A joint-arm awning according to claim 2, wherein the setscrew (21) engages the threaded hole from below the adjustment means, said setscrew having an axis approximately parallel to the surface (20) on the fastening bracket (2) when engaged in the treaded hole.

4. A joint-arm awning according to claim 1, wherein lateral recess (16) of the support pipe (1) is a semi-circular depression and wherein the outer end of the lateral recess (16) is correspondingly shaped and positively engages with said lateral recess.

* * * * *